US012121095B1

(12) United States Patent
Leon

(10) Patent No.: US 12,121,095 B1
(45) **Date of Patent: *Oct. 22, 2024**

(54) HELMET

(71) Applicant: Lionhead Helmet Intellectual Properties, LP, Ambler, PA (US)

(72) Inventor: Robert L. Leon, Ambler, PA (US)

(73) Assignee: LIONHEAD HELMET INTELLECTUAL PROPERTIES, LP, Ambler, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/644,944

(22) Filed: Apr. 24, 2024

(51) Int. Cl.
*A42B 3/12* (2006.01)
*A42B 3/06* (2006.01)

(52) U.S. Cl.
CPC ..... *A42B 3/127* (2013.01); *A42B 3/06* (2013.01)

(58) Field of Classification Search
CPC .. A42B 3/127; A42B 3/06; A42B 3/10; A42B 3/128
USPC ..... 2/411, 412, 414, 418, 419, 425
See application file for complete search history.

(56) References Cited

U.S. PATENT DOCUMENTS

| | | | | |
|---|---|---|---|---|
| 2,835,313 | A | 5/1958 | Dodge | |
| 3,425,061 | A | 2/1969 | Webb | |
| 3,577,562 | A | 5/1971 | Holt | |
| 3,872,511 | A * | 3/1975 | Nichols | A42B 3/121 267/114 |
| 3,877,076 | A | 4/1975 | Summers et al. | |
| 3,943,572 | A | 3/1976 | Aileo | |
| 4,290,149 | A | 9/1981 | Aileo | |
| 4,307,471 | A | 12/1981 | Lovell | |
| 4,345,338 | A | 8/1982 | Frieder, Jr. et al. | |

(Continued)

FOREIGN PATENT DOCUMENTS

| | | | |
|---|---|---|---|
| CN | 101850638 | A | 10/2010 |
| DE | 4226588 | A1 | 2/1994 |

(Continued)

OTHER PUBLICATIONS

Rowson et al., "Linear and Angular Head Acceleration Measurements in Collegiate Football," Journal of Biomechanical Engineering, Vo. 131, 7 pages (Jun. 2009).

(Continued)

*Primary Examiner* — Tajash D Patel
(74) *Attorney, Agent, or Firm* — Panitch Schwarze Belisario & Nadel LLP

(57) ABSTRACT

A helmet which is to be worn on a head of a wearer. The helmet includes a shell adapted to surround a wearer's head with the inner surface of the shell being spaced from the wearer's head at an initial pre-impact relative position. A subliner in contact with the wearer's head when the helmet is worn prior to an impact and during an impact, includes at least one viscoelastic foam subliner element extending from the inner surface of the shell. The subliner element is radially partitioned into individual and independent panel-shaped segments nested with respect to each other and have major side surfaces. Some of the nested segments have double-sided nano tape positioned between the major side surfaces thereof in direct contacting engagement with the nano tape and at least some of the major side surfaces of the remaining nested segments are in direct facing relation without nano tape therebetween.

28 Claims, 10 Drawing Sheets

(56) References Cited

U.S. PATENT DOCUMENTS 4,534,068 A 8/1985 Mitchell et al.
4,586,200 A * 5/1986 Poon ..... A42B 3/122 2/424
5,030,501 A 7/1991 Colvin et al.
5,168,576 A * 12/1992 Krent ..... A41D 13/0156 2/463
5,204,998 A 4/1993 Liu et al.
5,589,016 A 12/1996 Hoopingarner et al.
5,713,082 A 2/1998 Bassette et al.
5,815,846 A 10/1998 Calonge
5,950,244 A * 9/1999 Fournier ..... A42B 3/128 2/425
5,956,777 A 9/1999 Popovich
5,970,550 A 10/1999 Gazes
6,070,271 A 6/2000 Williams
6,070,905 A 6/2000 Renault
6,219,850 B1 4/2001 Halstead et al.
6,298,497 B1 10/2001 Chartrand
6,308,490 B1 10/2001 Saebi
6,324,700 B1 12/2001 McDougall
6,453,476 B1 9/2002 Moore, III
6,658,671 B1 12/2003 Von Holst et al.
6,871,525 B2 3/2005 Withnall et al.
6,934,971 B2 8/2005 Ide et al.
6,968,575 B2 11/2005 Durocher
7,240,376 B2 7/2007 Ide et al.
7,367,898 B2 5/2008 Hawkins et al.
7,461,726 B2 12/2008 Hawkins et al.
7,603,725 B2 10/2009 Harris
7,673,351 B2 * 3/2010 Copeland ..... A41D 31/285 2/425
7,676,854 B2 3/2010 Berger et al.
7,774,866 B2 8/2010 Ferrara
7,802,320 B2 9/2010 Morgan
7,832,023 B2 11/2010 Crisco
7,900,279 B2 3/2011 Kraemer et al.
7,930,771 B2 4/2011 Depreitere et al.
7,954,177 B2 6/2011 Ide et al.
7,954,178 B2 6/2011 Durocher et al.
8,015,624 B2 9/2011 Baldackin et al.
8,127,373 B1 3/2012 Fodemski
8,166,574 B2 5/2012 Hassler
8,191,179 B2 6/2012 Durocher et al.
8,196,226 B1 6/2012 Schuh
8,347,421 B2 1/2013 Krueger
8,365,315 B2 2/2013 Ortiz et al.
8,387,164 B2 3/2013 Maddux et al.
8,402,715 B2 3/2013 Uhllg et al.
8,578,520 B2 11/2013 Halldin
8,640,267 B1 2/2014 Cohen
8,931,606 B2 1/2015 Hawkins et al.
8,955,169 B2 2/2015 Weber et al.
9,032,558 B2 5/2015 Leon
9,578,917 B2 2/2017 Cohen
9,975,032 B2 5/2018 Frey
10,136,691 B2 * 11/2018 Degolier ..... A42B 3/12
10,869,520 B1 12/2020 Leon
11,547,166 B1 * 1/2023 Leon ..... A42B 3/128
2001/0031350 A1 10/2001 Day et al.
2002/0023291 A1 2/2002 Mendoza
2002/0056521 A1 5/2002 Chen et al.
2003/0140400 A1 7/2003 Ho
2004/0117896 A1 6/2004 Madey et al.
2004/0250340 A1 12/2004 Piper et al.
2005/0246824 A1 11/2005 Berger et al.
2006/0031978 A1 2/2006 Pierce
2006/0059606 A1 3/2006 Ferrara
2006/0070170 A1 4/2006 Copeland et al.
2006/0112477 A1 6/2006 Schneider
2007/0068755 A1 3/2007 Hawkins et al.
2008/0066217 A1 3/2008 Depreitere et al.
2008/0120764 A1 5/2008 Sajic
2008/0155735 A1 7/2008 Ferrara
2008/0172779 A1 * 7/2008 Ferguson ..... A41D 31/285 2/455
2008/0256685 A1 10/2008 Lampe et al.
2009/0000377 A1 1/2009 Shipps et al.
2009/0024406 A1 1/2009 Rawls-Meehan
2009/0151056 A1 6/2009 Desjardins et al.
2009/0218185 A1 9/2009 Lin
2009/0265839 A1 10/2009 Young et al.
2009/0320185 A1 12/2009 Hassler
2010/0005573 A1 1/2010 Rudd et al.
2010/0299812 A1 12/2010 Maddux et al.
2010/0319109 A1 12/2010 Field
2011/0072587 A1 3/2011 Cao et al.
2011/0107503 A1 5/2011 Morgan
2011/0117310 A1 5/2011 Anderson et al.
2011/0131695 A1 6/2011 Maddux et al.
2011/0171420 A1 7/2011 Yang
2011/0252544 A1 10/2011 Abernethy
2011/0271427 A1 11/2011 Milsom
2011/0277221 A1 11/2011 Ide et al.
2012/0047635 A1 3/2012 Finiel et al.
2012/0096631 A1 4/2012 King et al.
2012/0143526 A1 6/2012 Benzel et al.
2012/0151663 A1 6/2012 Rumbaugh
2012/0151664 A1 6/2012 Kirshon
2012/0186002 A1 7/2012 Bhatnagar et al.
2012/0186003 A1 7/2012 Heger et al.
2012/0192337 A1 8/2012 Divine et al.
2012/0198604 A1 8/2012 Weber et al.
2012/0198605 A1 8/2012 Maddux et al.
2012/0204329 A1 8/2012 Faden et al.
2012/0207964 A1 8/2012 Faden et al.
2012/0208032 A1 8/2012 Faden et al.
2012/0216339 A1 8/2012 Nimmons et al.
2012/0233745 A1 9/2012 Veazie
2012/0266365 A1 10/2012 Cohen
2012/0266366 A1 10/2012 Ferrara
2012/0297525 A1 11/2012 Bain
2012/0304366 A1 12/2012 Daoust
2012/0304367 A1 12/2012 Howard et al.
2012/0317705 A1 12/2012 Lindsay
2012/0324634 A1 12/2012 Coyle
2013/0000016 A1 1/2013 Hall et al.
2013/0000017 A1 1/2013 Szalkowski et al.
2013/0000018 A1 1/2013 Rudd et al.
2013/0007950 A1 1/2013 Arai
2013/0019384 A1 1/2013 Knight
2013/0019385 A1 1/2013 Knight
2013/0025031 A1 1/2013 Laperriere et al.
2013/0025032 A1 1/2013 Durocher et al.
2013/0025033 A1 1/2013 Durocher et al.
2013/0036531 A1 2/2013 Belanger et al.
2013/0040524 A1 2/2013 Halldin et al.
2013/0042397 A1 2/2013 Halldin
2013/0055488 A1 3/2013 Garneau
2013/0061371 A1 3/2013 Phipps et al.
2013/0061372 A1 3/2013 Goldstein
2013/0061375 A1 3/2013 Bologna et al.
2013/0111654 A1 5/2013 Gorsen et al.
2013/0122256 A1 5/2013 Kleiven et al.
2013/0185837 A1 7/2013 Phipps et al.
2013/0254978 A1 10/2013 McInnis et al.
2013/0291289 A1 11/2013 Szalkowski et al.
2013/0340147 A1 12/2013 Giles
2014/0013492 A1 1/2014 Bottlang et al.
2014/0020158 A1 1/2014 Parsons et al.
2014/0096311 A1 4/2014 Halldin
2014/0170372 A1 6/2014 Fink
2014/0196198 A1 7/2014 Cohen
2014/0196998 A1 7/2014 Nauman et al.
2015/0000018 A1 1/2015 Brandt
2015/0223546 A1 8/2015 Cohen
2016/0021965 A1 1/2016 Mayerovitch
2017/0065018 A1 3/2017 Lindsay

(56) References Cited

U.S. PATENT DOCUMENTS

| | | | |
|---|---|---|---|
| 2018/0249778 | A1 | 9/2018 | Brandt et al. |
| 2019/0029352 | A1 | 1/2019 | Sadegh et al. |

FOREIGN PATENT DOCUMENTS

| | | | | |
|---|---|---|---|---|
| EP | 1142495 | A1 | 10/2001 | |
| EP | 2835069 | A1 * | 2/2015 | ..... A41D 13/0153 |
| GB | 2530309 | A | 3/2016 | |
| WO | 2004032659 | A1 | 4/2004 | |
| WO | 2020236930 | A1 | 11/2020 | |

OTHER PUBLICATIONS

Broglio et al., "Biomechanical Properties of Concussions in High School Football," Medicine and Science in Sports Exercise; www.medscape.com, pp. 1-10, (Nov. 23, 2010).
Greenwald et al., "Head Impact Telemetry System (HITSTM) for Measurement of Head Acceleration in the Field," American Society of Biomechanics—2003 Annual Meeting, 2 pages.
Daniel et al., "Head Impact Exposure in Youth Football," Annals of Biomedical Engineering, 6 pages (Feb. 15, 2012).
ASTM F 1446-04, "Standard Test Methods for Equipment and Procedures Used in Evaluating the Performance Characteristics of Protective Hedgear," ASTM International, pp. 1-11 (date: unknown).
"Head Injuries in Football," The New York Times, pp. 4 (Nov. 16, 2011).
Rousseau et al., "A Comparison of Peak Linear and Angular Headform Accelerations Using Ice Hockey Helmets," Journal of ASTM International; www.astm.org, vol. 6, No. 1, 11 pages (Feb. 20, 2009).
Rowson et al., "Development for the STAR Evaluation System for Football Helmets: Integrating Player Head Impact Exposure and Risk of Concussion," Annals of Biomedical Engineering, 11 pages (May 7, 2011).
Rousseau et al., "The Influence of Deflection and Neck Compliance on the Impact Dynamics of a Hybrid III Headform," Proceedings of the Institution of Mechanical Engineers, vol. 223, Part P: J. Sports Engineering and Technology, pp. 89-97 (Apr. 3, 2009).
"2011 Concussion Report—End of Regular Season," 4 pages (Jan. 10, 2012).
Shipley, "Traumatic Brain Injury and Diffuse Axonal Injury," Trial Image Inc.; www.trialimagestore.com, pp. 1-5 (Feb. 18, 2011).
Newman et al., "A New Biomechanical Assessment of Mild Traumatic Brain Injury Part 2—Results and Conclusions," 11 pages, (date: unknown).
King et al., "Is Head Injury Caused by Linear or Angular Acceleration?," IRCOBI Conference, pp. 1-12 (Sep. 2003).
NOCSAE DOC (ND) 001-11M11, "Standard Test Method and Equipment Used in Evaluating the Performance Characteristics of Protective Headgear Equipment," NOCSAE/National Operating Committee on Standards for Athletic Equipment, pp. 1-25 (Jan. 2012).
NOCSAE DOC (ND) 002-11m11a, "Standard Performance Specification for Newly Manufactured Football Helmets," NOCSAE/National Operating Committee on Standards for Athletic Equipment, pp. 1-6 (Feb. 2012).
"NOCSAE receives $1.1M Research Grants to Advance Science of Sports Medicine," 2 pages (Jun. 20, 2011).
"Helmet Safety Group Approves Research Grants," SFGate.com, 1 page (Jun. 18, 2011).
Bartholet, "The Collision Syndrome," Scientific American, pp. 68-71 (Feb. 2012).
Kluger, "Headbanger Nation. Concussions are clobbering U.S. kids. Here's why," Time Magazine, pp. 42-51 (Jan. 31, 2011).
"Concussion," Wikipedia, 17 pages (page last modified on May 21, 2012).
"Frustoconical," Wiktionary, N.p., n.d. Web. Aug. 4, 2015.
"Frustum." Wiktionary. N.p., n.d. Web. Aug. 4, 2015.
"EZ Dri." INOAC. INOAC, n.d. Web Mar. 2, 2016.
"Outdoor Foam Cushion, Waterproof Foam, Patio Cushion, Furniture Cushions." Outdoor Foam Cushion, Waterproof Foam, Patio Cushion, Furniture Cushions. N.p., n.d. Web Mar. 2, 2016.
"Reticulated Polyurethane Foam", Producer of Custom-Engineered Components, Products & Packaging, 4 pages (Oct. 2016).
Qi, HJ and Boyce, MC, Stress-strain Behavior of Thermoplastic Polyurethane. Submitted to Mechanics of Materials. Submitted Dec. 2003, Revised Jul. 2004.
Orringer, et al., Crash Padding Research, vol. 1, Material Mechanical Properties, Final Report, Accessed through the National Academies of Sciences, Engineering Medicine, 1986-87.

* cited by examiner

HELMET

BACKGROUND OF THE INVENTION

The present disclosure generally relates to a helmet whose purpose is to protect a wearer's head during a head impact. Extending radially outward from the wearer's head, the helmet may consist of one or multiple liner portions and one or multiple shell portions. Either way, there is typically a liner portion in contact with the wearer's head initially or during impact, that liner portion being herein defined as the subliner. The subliner may be comprised of individual subliner elements. The subliner is typically attached to an inner shell portion, the term inner having been added to unambiguously differentiate it from an outer shell portion in the case of a helmet with multiple shell portions. In helmets having just a single liner portion and a single shell portion, the liner portion would be the same as the subliner and the shell portion would be the same as the inner shell portion. In some helmets (typically hockey helmets) the inner shell portion may consist of individual shell segments. The subliner and inner shell portion together are herein defined as the helmet subliner system, and the present disclosure comprises an improved helmet subliner system, and an improved outer liner portion in the case of multiple shell helmets, to better protect the wearer from sustaining concussions and other head injuries.

Especially in multiple liner, multiple shell helmets, the subliner, as defined herein has been used primarily for obtaining the best fit and best comfort for the wearer. But as will be shown in this specification, the subliner, and more generally the subliner system may also be used to substantially improve the head protection performance of the helmet. The disclosure recognizes and takes advantage of the fact that all the forces that are applied to the wearer's head during a head impact are preferably applied through the subliner and its elements.

Recent postmortem brain investigations have found a high instance of chronic traumatic encephalopathy, or CTE, in the donated brains of deceased NFL football players, many of whom had suffered debilitating symptoms during their lifetimes, including unexplained rage, extreme mood swings, and substantial cognitive degeneration, all of which may have begun years after their football playing ended. Current research shows that CTE can almost always be traced back to long term repetitive head impacts which may include both concussive and sub-concussive impacts. It is believed those impacts would have been characterized by a high level of head angular acceleration, sometimes called rotational acceleration.

To reduce a wearer's head rotational acceleration, an effective helmet design may combine two strategies: one, absorb maximum impact energy to lower the impact force and acceleration, and two, redirect the now lowered force further down on the wearer's head to reduce head rotational acceleration.

In U.S. Pat. No. 11,547,166 B1, subliner elements attached to the inner surface of a surrounding shell are confined to a headband area of a user's head as part of the second strategy. As part of the first strategy, the subliner elements contain individual viscoelastic foam segments and double-sided nano tape in between the foam segments, whereby the foam segments absorb impact energy mostly from the rapid compression of the foam, and the nano tape in between the foam segments absorbs impact energy primarily from the rapid bending of the foam segments. Bending can occur when the shell end of a subliner element is displaced transversely with respect to the head end of the subliner element. The bending stretches the foam side surfaces on their convex side and shortens them on their concave side so that the nano tape in between adjacent bending foam segments becomes sheared across its thickness and absorbs energy as a result. However, for a subliner element located beneath a direct impact, the foam segments merely compress, and do not bend. Thus, in this case, less energy is absorbed by the element's nano tape.

This inherent shortcoming is overcome in the present disclosure by means of a new configuration of viscoelastic foam segments and nano tape. The disclosed new configuration results in increased bending of the viscoelastic foam segments, and thereby increased energy absorption by the nano tape in between, not just when the subliner element is directly compressed with no transverse motion between its shell end and head end, but also in cases when previously there would have been some bending. It thus results in more energy absorption by the nano tape portion of a subliner element, regardless of where the subliner element is located relative to an impact.

SUMMARY OF THE INVENTION

Briefly stated, the present disclosure is directed to a helmet adapted to be worn on a head of a wearer. The helmet includes a shell comprised of a hard impact resistant material having inner and outer surfaces. The shell is adapted to surround at least a portion of the cranial part of wearer's head with the inner surface of the shell being spaced from the wearer's head at an initial pre-impact relative position when the helmet is worn. A subliner, at least a part of which is adapted to be in contact with the wearer's head when the helmet is worn prior to an impact and during an impact, includes at least one subliner element extending from the inner surface of the shell. The at least one subliner element being constructed of an energy absorbing viscoelastic foam material. The at least one subliner element is radially partitioned into individual and independent panel-shaped segments nested with respect to each other and having major side surfaces. At least some of the nested segments have double-sided nano tape positioned between the major side surfaces thereof in direct contacting engagement with the nano tape and at least some of the major side surfaces of the remaining nested segments are in direct facing relation without nano tape therebetween.

In another aspect, the present disclosure is directed to a helmet adapted to be worn on a head of a wearer. The head has a pair of eyebrows, a pair of ears, and an annular headband shaped area encircling the wearer's head. The headband shaped area is approximately 0.75 to 1.25 inches wide and has a lower edge defining a plane positioned approximately 0.5 to 1.5 inches above the eyebrows and approximately 0.25 to 0.75 inches above an upper junction of the ears and the wearer's head. A top area centered about a top of the wearer's head encompassing approximately 0.44 to 7 square inches. A middle area of the head is defined between the headband area and the top area. The helmet includes a shell comprised of a hard impact resistant material. The shell has inner and outer surfaces and is adapted to surround at least a portion of the cranial part of wearer's head with the inner surface of the shell being spaced from the wearer's head at an initial pre-impact relative position when the helmet is worn. A subliner, at least a part of which is adapted to be in contact with the wearer's head when the helmet is worn prior to an impact and during an impact, includes a plurality of a first type of subliner elements extending from the inner surface of the shell at a location such that the first type of subliner elements are adapted to be aligned with the headband area when the helmet is worn. The first type of subliner elements is constructed of an energy absorbing viscoelastic foam material. The first type of subliner elements is radially partitioned into individual and independent panel-shaped segments nested with respect to each other and having major side surfaces. At least some of the nested segments have double-sided nano tape positioned between the major side surfaces thereof in direct contacting engagement with the nano tape and at least some of the major side surfaces of the remaining nested segments are in direct facing relation without nano tape therebetween. An apex type of subliner element extends from the inner surface of the shell at a location such that the apex type of subliner element is adapted to be aligned with the top area when the helmet is worn. The apex type of subliner element is comprised of an energy absorbing viscoelastic foam material and has a substantially flat lower surface which is substantially tangent to a surface of the wearer's head beneath it when the helmet is worn.

In another aspect, the present disclosure is directed to a helmet adapted to be worn on a head of a wearer. The head has a pair of eyebrows, a pair of ears, and an annular headband shaped area encircling the wearer's head. The headband shaped area is approximately 0.75 to 1.25 inches wide and has a lower edge defining a plane positioned approximately 0.5 to 1.5 inches above the eyebrows and approximately 0.25 to 0.75 inches above an upper junction of the ears and the wearer's head. A top area centered about a top of the wearer's head encompassing approximately 0.44 to 7 square inches. A middle area of the head is defined between the headband area and the top area. The helmet includes a shell comprised of a hard impact resistant material. The shell has inner and outer surfaces and is adapted to surround at least a portion of the cranial part of wearer's head with the inner surface of the shell being spaced from the wearer's head at an initial pre-impact relative position when the helmet is worn. A subliner, at least a part of which is adapted to be in contact with the wearer's head when the helmet is worn prior to an impact and during an impact, includes a plurality of a first type of subliner elements extending from the inner surface of the shell at a location such that the first type of subliner elements is adapted to be aligned with the headband area when the helmet is worn. The first type of subliner elements is constructed of an energy absorbing viscoelastic foam material and is radially partitioned into individual and independent panel-shaped segments nested with respect to each other. The panel-shaped segments have major side surfaces. At least some of the nested segments have double-sided nano tape positioned between the major side surfaces thereof in direct contacting engagement with the nano tape and at least some of the major side surfaces of the remaining nested segments are in direct facing relation without nano tape therebetween. An apex type of subliner element extends from the inner surface of the shell at a location such that the apex type of subliner element is adapted to be aligned with the top area when the helmet is worn. The apex type of subliner element is comprised of an energy absorbing viscoelastic foam material. The apex type of subliner element has a substantially flat lower surface which is substantially tangent to the surface of the wearer's head beneath it when the helmet is worn. An outer shell, comprised of a hard impact resistant material and having inner and outer surfaces, surrounds at least a portion of the inner shell. The inner surface of the outer shell being spaced from the outer surface of the inner shell at an initial pre-impact relative position. A plurality of outer liner elements are located in the space between the outer surface of the inner shell and the inner surface of the outer shell and are attached to both the outer surface of the inner shell and the inner surface of the outer shell. At least one of the outer liner elements is comprised of an energy absorbing viscoelastic foam and is radially partitioned into individual and independent panel-shaped segments nested with respect to each other. The panel-shaped segments have major side surfaces. At least some of the nested segments of the at least one outer liner element have double-sided nano tape positioned between the major side surfaces thereof in direct contacting engagement with the nano tape and at least some of the major side surfaces of the remaining nested segments of the at least one outer liner element are in direct facing relation without nano tape therebetween.

BRIEF DESCRIPTION OF THE DRAWINGS

The foregoing summary, as well as the following detailed analysis of the physical principles and detailed descriptions of the preferred embodiments will be better understood when read in conjunction with the appended drawings. For the purpose of illustrating the disclosure, particular arrangements and methodologies of preferred embodiments are shown in the drawings. It should be understood, however, that the disclosure is not limited to the precise arrangements or instrumentalities shown or the methodologies of the detailed description. In the drawings.

DETAILED DESCRIPTION OF THE INVENTION

Figure 1:
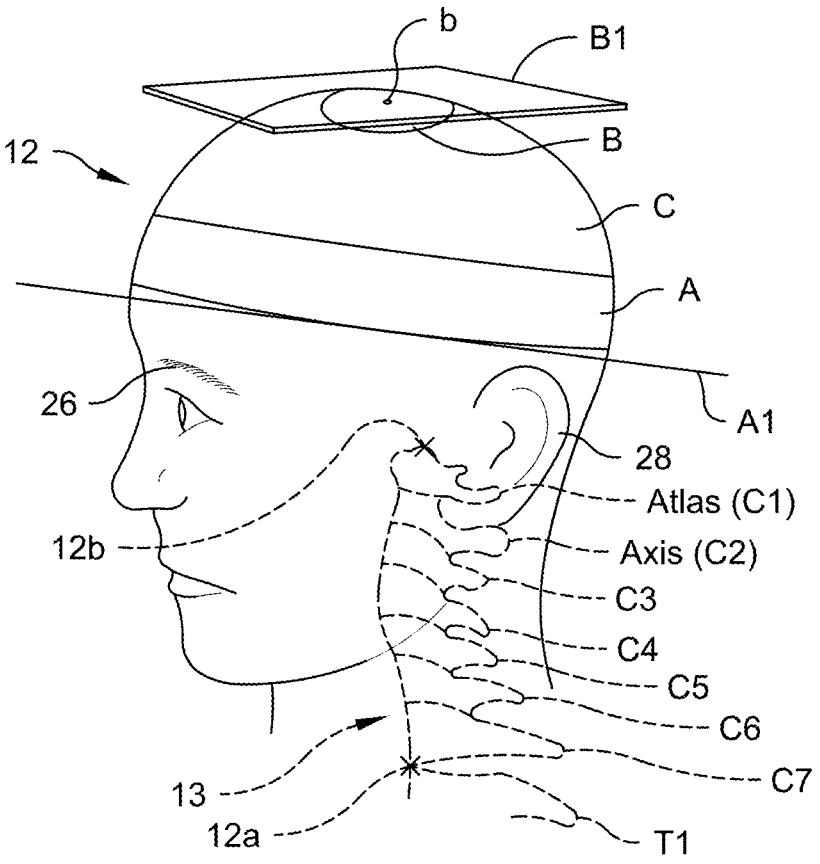
FIG. 1 is a perspective side view of a wearer's head with defined areas, planes, and points in accordance with the present disclosure.

Certain terminology is used in the following description for convenience only and is not limiting. The words "lower," "bottom," "upper" and "top" designate directions in the drawings to which reference is made. The words "inwardly," "outwardly," "upwardly" and "downwardly" refer to directions toward and away from, respectively, the geometric center of the helmet, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import. The terms "angular acceleration" and "rotational acceleration" should be taken as synonymous from a force vector perspective. Similarly, the words "acceleration" and "deceleration" should also be taken as synonymous from a force vector perspective. It should also be understood that the terms "about," "approximately," "generally," "substantially" and like terms, used herein when referring to a dimension or characteristic of a component of the disclosure, indicate that the described dimension/characteristic is not a strict boundary or parameter and does not exclude minor variations therefrom that arc functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Figure 2:
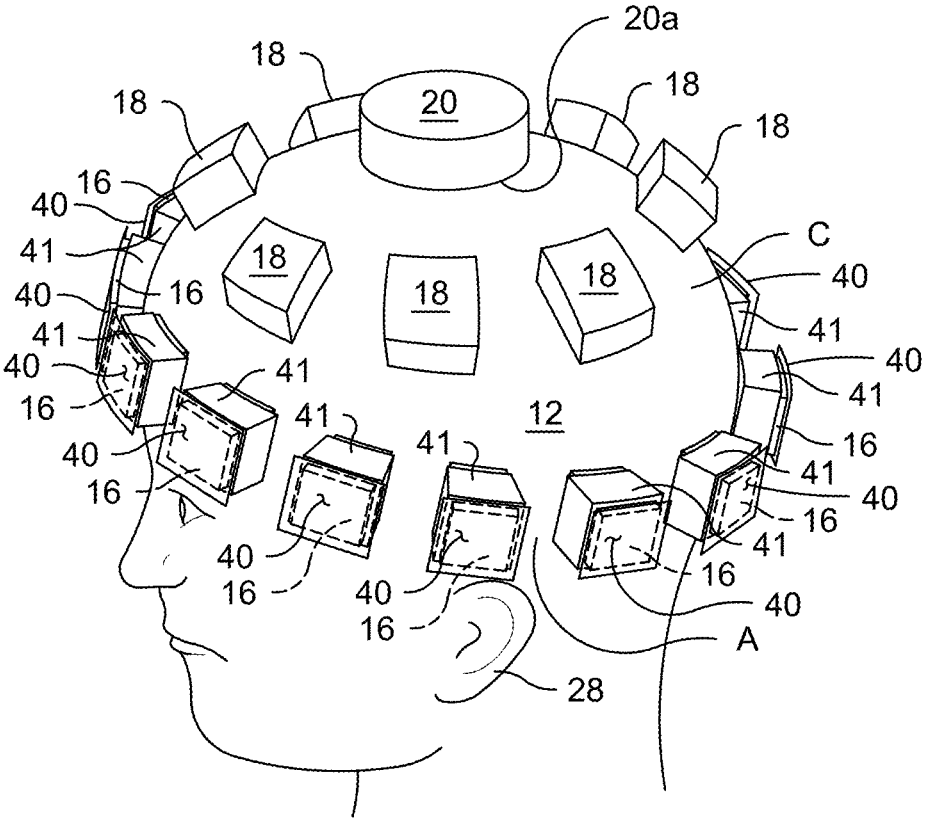
FIG. 2 is a perspective upper side view of a wearer's head showing the three types of subliner elements as they would be located in their respective designated areas, in accordance with a first embodiment of the present disclosure.
Figure 4:
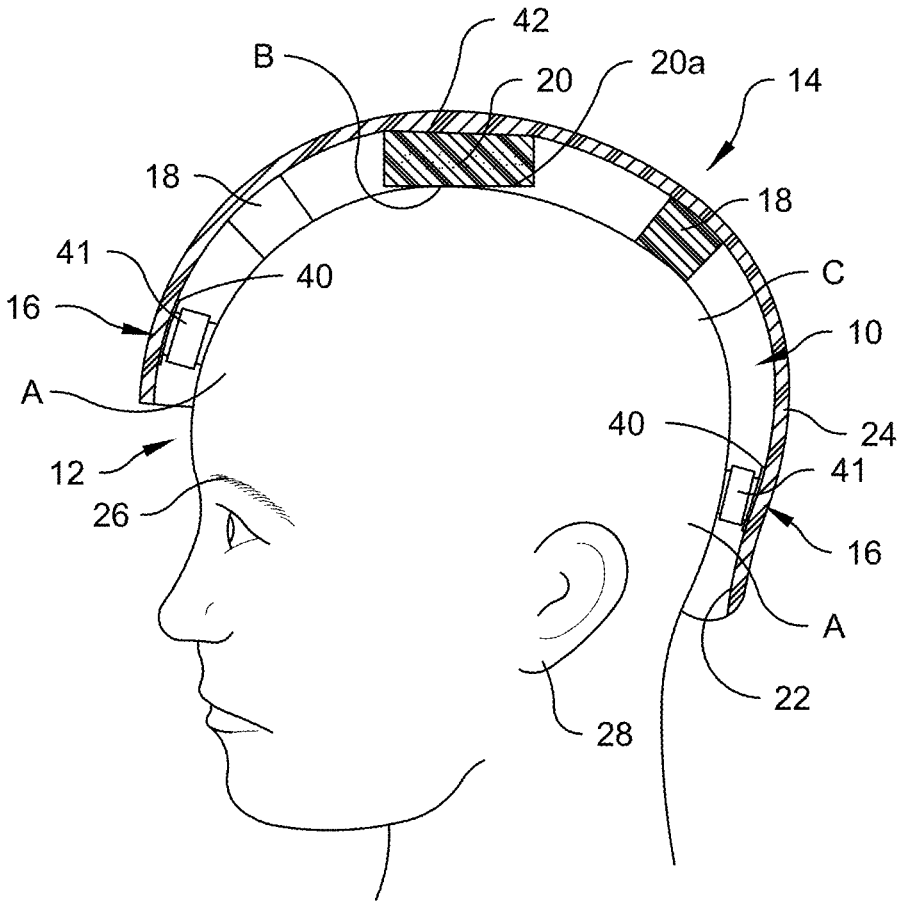
FIG. 4 is cross-sectional side view at the midsagittal plane of a wearer's head, showing the subliner elements of FIG. 2 and the inner shell to which they are attached forming a subliner system in accordance with the present disclosure.

Referring now to FIGS. 1, 2 and 4, to best understand the configuration of the helmet subliner system or subliner 10, which is a subject of this disclosure, it will be useful to first define certain areas of a potential wearer's head 12 which could come in contact with various types of subliner elements of the helmet 14. In this regard, all the following will be defined: first area A, first plane Al, second plane B1, point b, second area B, and third area C.

FIG. 1 is a perspective side view of a wearer's head 12 having a pair of eyebrows 26 (only one is shown) and a pair of cars 28 (only one is shown). The head 12 includes a first area A, first plane Al, second plane B1, point b, second area B, and third area C. First area A is an annular headband shaped area encircling the wearer's head 12. The first or headband shaped area A being approximately 0.75 to 1.25 inches wide, and preferably approximately 1.0 inch wide, and having a lower edge defining a plane positioned approximately 0.5 to 1.5 inches, and preferably approximately 1.0 inch, above the eyebrows 26 and approximately 0.25 to 0.75 inches, and preferably approximately 0.5 inches, above a location where the cars 28 join the wearer's head 12 at the top or, stated differently, an upper junction of the cars 28 and the wearer's head 12. The first plane Al is a hypothetical plane defined by the lower edge of first area A. Picture second plane B1 as a lower cover of an imaginary hard cover book being balanced horizontally atop the wearer's head 12 while the wearer's head 12 is maintained in an upright position, tilted neither right nor left, nor forward nor backward and where point b is approximately the center of the contact area between the lower cover of the imaginary book and the wearer's head 12. Notice that first plane Al is tilted upward in the forward direction (the direction toward the face of the wearer) relative to second plane B. In FIG. 1, the second plane B1 is shown as transparent so that the contact area with the wearer's head 12, point b, is apparent. The second or top area B is formed by a planar projection of an approximate 2-inch diameter circle (not shown) formed in the second plane B1 centered about point b onto the wearer's head. That is, the second area B is generally circular and is centered about a top of the wearer's head 12 and extends 0.75 to 3 inches, and preferably 2 inches, in diameter in all lateral directions. As will be discussed, the second area B needn't be 2 inches in diameter, nor even circular. That is, the second area B can range from 0.44 to 7 square inches, or preferably 3.14 square inches. The third or middle area C is the area on the wearer's head 12 between first area A and second area B.

Referring again to FIGS. 1, 2 and 4 and as will be described in detail in subsequent sections of the specification, subliner elements of a first type 16 are to be located in the first area A; subliner elements of a second type 18 are to be considered optional since they don't substantially contribute to the rotational acceleration reduction capability of the helmet, only to its comfort and fit, but when included they are to be utilized in third area C, and a subliner element of an apex type 20 is to be used in second area B. Each type of subliner element 16, 18, 20 has its own specific physical characteristics in accordance with the purpose of the disclosure which is to be able to reduce the level of head angular acceleration imparted to a wearer's head 12 during a head impact, regardless of the location or direction of the impact. Each of the subliner elements 16, 18, 20 is to be attached to an inner surface 22 of the inner shell 24 of the helmet 14, preferably utilizing a commonly employed hook and loop type of fastener arrangement which allows for the simple assembly of, and changeout of, individual subliner elements 16, 18, 20 during a fitting process, with each subliner element 16, 18, 20 being positioned and sized in its thickness direction to best fit the size and shape of a wearer's head 12. It will be appreciated by one skilled in the art, that other fastening elements could be used to releasably secure the subliner elements 16, 18, 20 to the inner surface 22 of the inner shell 24 of the helmet 14, such as a releasable adhesive (not shown).

FIG. 2 is a perspective upper side view of a wearer's head 12 showing the first, second and apex types of subliner elements 16, 18, 20 as they would be located in their respective designated areas shown in FIG. 1, in accordance with a first embodiment of the present disclosure. The individual subliner elements 16, 18, 20 are not attached to the wearer's head 12 (as could be falsely assumed from FIG. 2) but are merely illustrated in the figure where they would be located with respect to the wearer's head 12 when the helmet 14 is worn. Typically, they would be attached to the inner surface 22 of the inner shell 24 of the helmet 14, as shown in FIG. 4, preferably utilizing a commonly employed hook and loop type of fastener arrangement, described below. Alternatively, subliner elements 18 may be similarly attached to the side surface of subliner element 20. The upper side viewpoint enables a fuller view of subliner element of the apex type 20, which is preferably disc or oval shaped, oriented generally in the second plane B1, and is centered about point b at the top, or crown, of the head 12. Subliner element of the apex type 20 has a flat (or nearly flat), horizontal (or nearly horizontal), lower surface 20*a* which may be either initially in contact with the wearer's head 12 or slightly spaced therefrom but may come into contact with the wearer's head 12 during an impact. Subliner element of the apex type 20 is shown here as a circular disc having a two-inch diameter to accommodate any misalignment of the center of the disc with the initial actual point of contact with a wearer's head 12 and to accommodate lateral displacements between the inner shell 24 and the wearer's head 12 during an impact. In general, the subliner element of the apex type 20 need not be circular, but it may be of any suitable contiguous shape typically having that approximate area or greater. The important thing is that its lower surface 20*a* be of sufficient area to enable the accommodations described above, and that it be predominately flat and horizontal such that it is substantially tangent to the surface of the wearer's head 12 beneath it when the helmet 14 is worn.

To be able to appreciate why the lower surface 20*a* of subliner element of the apex type 20 is preferred to be flat and horizontal, one may perform a simple experiment with one's own hand and one's own head. First, using one's hand, firmly cup the top of one's head. Then while still firmly cupping the head, forcefully move the cupping hand's forearm forward and backward, and side to side, and notice how the head is forced into violent motion likely involving significant head angular accelerations. Next, repeat the experiment while the hand is held flat and horizontal. The result: almost no forced motion of the head, and thus no head angular acceleration.

The subliner element of the apex type 20, and also the subliner elements of the first type 16, are preferably made of relatively stiff, very energy absorbent, viscoclastic foam material, capable of exhibiting a compressive stress of 20 psi for a static compression of 50% and at least 50 psi for a dynamic impact type compression of 50%, for example a vinyl nitrile foam such as IMPAX®, VN600, VN740, or VN1000 by Dertex Corporation, or a polyurethane foam such as LAST-A-FOAM®, FP 8015 by General Plastics Manufacturing Company. The subliner element of the apex type 20 should be thick enough not to compress all the way to its full densification condition under a peak normal impact force which could easily reach, and possibly even exceed, a thousand pounds. Although the weight of a full helmet would likely be substantially less than that (being typically under five pounds), if all the helmet weight were to be required to be supported by the subliner element of the apex type 20, with its high dynamic stiffness designed to accommodate a dynamic force of over a thousand pounds, the supporting area around point b for a static force of just five pounds could be so small that the supporting pressure could be uncomfortably high for the wearer were it not for the subliner elements of the second type 18, shown in third area C. This assumes the subliner elements 16 are not supporting much of the helmet weight. Alternatively, the subliner element of the apex type 20, could be constructed as described in U.S. Pat. No. 11,641,904 which is hereby incorporated by reference in its entirety.

Optional subliner elements of the second type 18, located in third area C, would preferably be made of a much more compliant material than that used for the subliner element of the apex type 20, preferably at least five times more compliant and perhaps more than an order of magnitude more compliant than the stiffer materials recommended for subliner element of the apex type 20. Such a material could be an extra soft polyurethane foam such as LAST-A-FOAM®, EF-4003 by General Plastics Manufacturing Company, or EZ-Dri foam by Crest Foam Industries, both having, a relatively flat static and dynamic compression stress vs. deflection characteristic (the former 2.6 psi at 10%, 2.7 psi at 20%, 2.8 psi at 30%, 3.0 psi at 40%, and 3.4 psi at 50% and the latter 0.3 psi at 10%, 0.35 psi at 20%, 0.4 psi at 30%, 0.45 psi at 40% and 0.55 psi at 50%), so when incorporating the proper total area to accomplish the function of supporting the full weight or nearly the full weight of the helmet with the latter material enabling about five times the support area for extreme comfort, the exact location and thickness of the subliner elements of the second type 18 would not be that critical for the subliner elements of the second type 18 to be able to successfully support all, or almost all, of the weight of the helmet, yet contribute very little side force to the wearer's head 12 during an impact. However, the second type of subliner elements 18 are preferably positioned generally equidistantly about and between the first and apex type of subliner elements 16, 20 in the third area C.

Figure 2A:
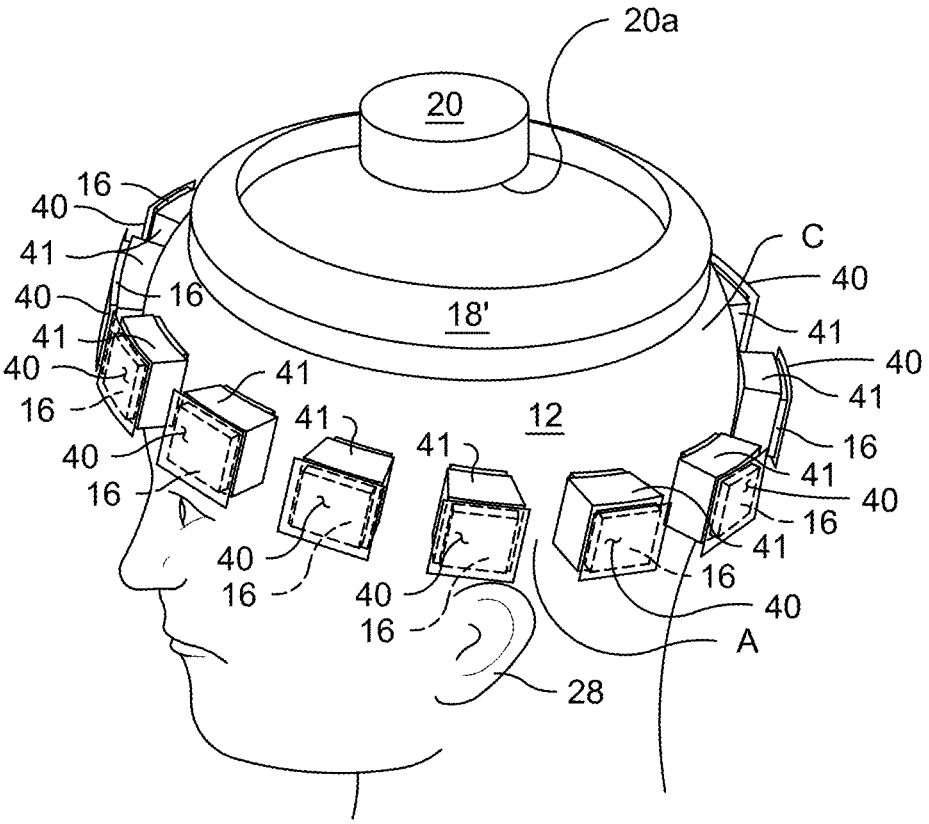
FIG. 2A is a perspective upper side view of a wearer's head showing the three types of subliner elements as they would be located in their respective designated areas, in accordance with a second embodiment of the present disclosure.

FIG. 2A shows a second embodiment of the present disclosure wherein there is at least one of an alternative optional second type of subliner element 18. That is, instead of a plurality of the second type of subliner elements 18 as shown in FIG. 2, the second type of subliner elements 18 in accordance with the second embodiment are instead formed as a single annular ring 18'. Using a single annular ring 18' has the advantage of easier assembly and greater simplicity. As with the first embodiment the ring type subliner element 18' may alternatively be attached to the side of subliner element 20. Otherwise, all other elements of the subliner system 10 of the second embodiment are identical to the first embodiment.

FIG. 1 schematically shows the cervical spine 13 and its seven cervical vertebrae labeled Atlas (C1), Axis (C2), C3, C4, C5, C6 and C7. For both centered (directed toward the center of gravity of a wearer's head) and non-centered impacts having a large horizontal force component, almost all the side forces (and torques) that would be imparted to a wearer's head 12 during an impact would be imparted through the subliner elements of the first type 16, which would be located, or substantially located, in first area A and generally evenly distributed/spaced thereabout. First area A places the point of application of these impact forces as close as possible to the head's two natural pivot points for angular acceleration: a lower pivot point 12*a* where the C7 cervical vertebrae (which can be located by the prominent bone at the base of the back of the neck) meets the T1 thoracic vertebrae, and an upper pivot point 12*b* where the C1 cervical vertebrae (the atlas bone) meets the paired occipital condyle projections of the skull to enable forward and backward rotation (a "yes" motion) of the head and where the atlas bone meets the C2 cervical vertebrae (the axis bone) enabling axial rotation (a "no" motion) and side-to-side rotation of the head, this latter pivot being located approximately just above and slightly in front of the car lobes. Thus, all the head angular accelerating torques imparted to the user's head during an impact would be kept as small as possible for a given force as a result of this lowest practical positioning of subliner elements of the first type 16.

As stated previously, the subliner element of the apex type 20, due to its flat horizontal lower surface 20*a*, typically does not impart a significant horizontal force to the wearer's head 12. Yet, there may be certain impacts during which the lower surface of the subliner element of the apex type 20 would not remain flat but instead would tend to cup around the surface of the wearer's head 12. One such type of impact is obvious: a direct downward impact to the crown, or top, of the helmet 14, centered toward the center of gravity (e.g.) of the wearer's head 12. Although that type of impact would result in cupping the lower surface of subliner element of the apex type 20 around the wearer's head 12, little or no horizontal force would be imparted to the wearer's head 12.

Another impact case that could cup the lower surface of the subliner element of the apex type 20 might be a downward impact to the top of the helmet at a point located away from the crown and generally directed toward the body of the wearer. Picture a running back diving over the goal line, his helmet getting struck in midair by the shoulder pad of a linebacker diving the other way to stop him. Here, in addition to a significant downward force through the subliner element of the apex type 20 (downward here meaning downward toward the body of the running back), there could be a not-insignificant horizontal force (horizontal here meaning horizontal relative to the body of the running back) imparted to the running back's head through the subliner element of the apex type 20, as well as through the subliner elements of the first type 16; for the most part the former would tend to rotate point b on the running back's head about the aforementioned upper pivot point toward the impact location, while the latter would tend to rotate point b about the aforementioned lower pivot point away from the impact location. So even in this case where the subliner element of the apex type 20 cannot avoid imparting a horizontal (sideways) force, the structure of the total subliner system 10 still tends to cancel the above two rotational head motions and thereby reduce the resultant angular acceleration of the wearer's head 12.

Further reductions of imparted torque levels can be achieved by lowering the impact force levels, which can be accomplished by a proper choice of material for the subliner elements of the first type 16, and by including specific structural features in the subliner elements of the first type 16. Especially during an impact involving mostly a horizontal force component, only about one third of the subliner elements of the first type 16 (those located in the wide general region beneath the impact point) would be imparting most of the side normal force and side tangential force to the wearer's head 12 since the remaining subliner elements of the first type 16 would have tended to move away from the wearer's head 12 during the impact as the force-imparting subliner elements of the first type 16 compress and/or flex as a result of the high impact forces.

The force levels could be of the same order of magnitude as those potentially experienced by the subliner element of the apex type 20 (up to, and perhaps even more than a thousand pounds), and so the same energy absorbing viscoelastic foam materials cited for subliner element of the apex type 20 would be in order for subliner elements of the first type 16, where their high energy absorption capability will help reduce the level of the high impact forces. The radial (thickness) dimension of the subliner elements of the first type 16 should be of sufficient length and have sufficient area to be able to avoid full densification at the maximum expected peak dynamic impact force, which could still be in the thousand-pound range for the total aggregate number of forces imparted on the subliner elements of the first type 16. On average the radial thickness of the subliner elements of the first type 16 would be approximately 0.25 to 1.25 inches, and preferably 0.75 inches.

In a preferred embodiment, to increase lateral compliance to help further reduce the imparted tangential side forces, the subliner elements of the first type 16 may be partitioned into radially partitioned into individual and independent panel-shaped segments 34 nested with respect to each other and having major side surfaces 36. More particularly, the panel-shaped segments 34 are generally flat and are generally rectangular or square shaped. The major side surfaces 36 are formed on both major sides of the panel-shaped segments 34. The panel-shaped segments 34 include four minor side surfaces 38 between the major side surfaces 36 which are relatively thin compared to the major side surfaces 36. In order to best achieve the goal of reduced imparted side forces, the major side surfaces 36 of the side-by-side panel-shaped segments 34 should be at least partially able to slide relative to each other in the segments' general radial direction. That is, at least some of the nested segments 34 have double-sided nano tape segments 39 positioned between the major side surfaces 36 thereof in direct contacting engagement with the nano tape 39 and at least some of the major side surfaces 36 of the remaining nested segments 34 are in direct facing relation without nano tape 39 therebetween. More particularly, it is preferred that the double-sided nano tape 39 be positioned between at least a majority of the facing major side surfaces 36 of the panel-shaped segments 34 except for two of the panel-shaped segments generally centrally positioned in the first subliner element 16.

Figure 3:
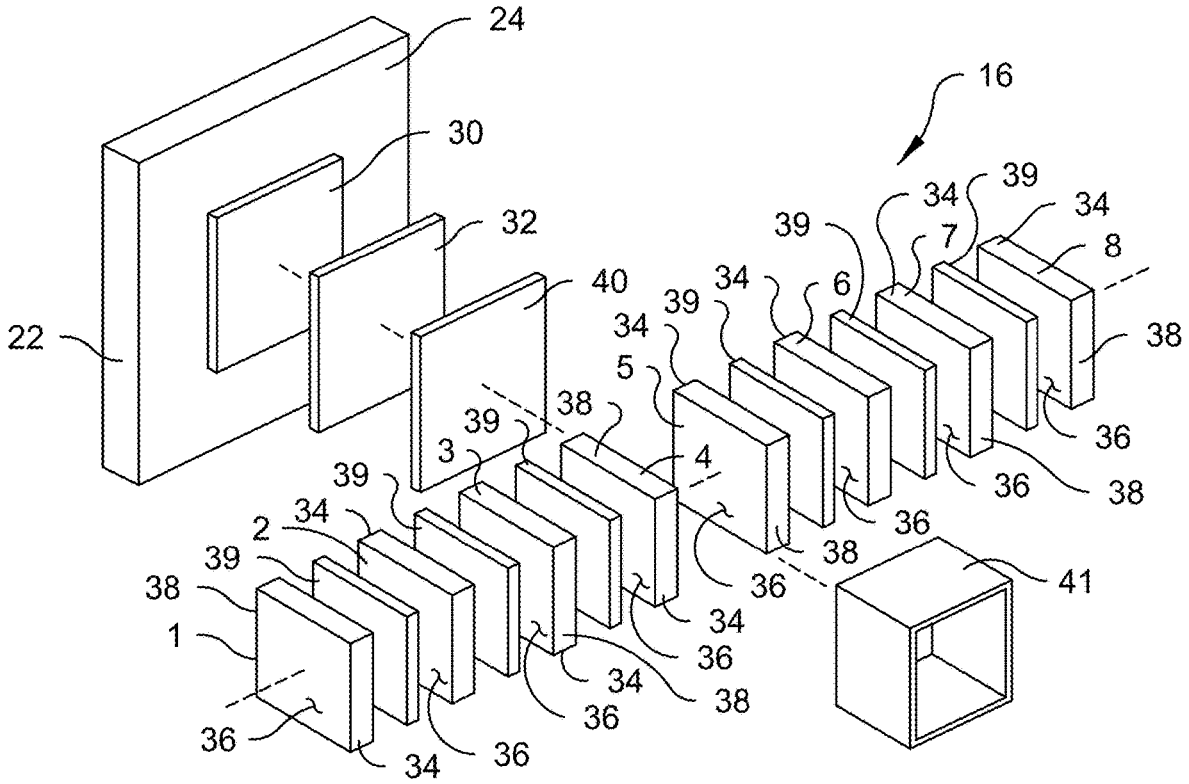
FIG. 3 is an exploded perspective view of a first type of subliner element.

As shown in FIG. 3, there are preferably a total of eight panel-shaped segments 34, with the two innermost or central panel-shaped segments in direct contact without nano tape 39 therebetween. The remaining panel-shaped segments 34 have nano tape 39 positioned therebetween. Each panel-shaped segment 34 preferably extends between 10 mm to 50 mm in one planar direction, between 10 mm to 50 mm in the other planar direction, and the panel thickness is preferably between 1.5 mm and 7.5 mm. The number of panels that make up one subliner element is preferably, but not necessarily, an even number, such as four, six, eight, or ten, etc. FIG. 3 shows a case with eight panel-shaped segments. Double-sided nano tape segments preferably with a thickness between 0.5 mm to 2.5 mm, preferably substantially fill the major side surfaces 36 between adjacent viscoelastic foam panel segments 34 with one key exception, the exception being the area between the foam panel segments 34 at or near the middle of the stack. In a pre-impact condition, the interior major side surfaces 36 of the middle two foam panel segments 34 are located side-by-side without nano tape 39 filling the space between them. For example, with eight panel-shaped segments 34, there would be only six nano tape segments 39, not seven. Three of the nano tape segments 39 would be located between panel-shaped segments 34 numbered 1 and 2, 2 and 3, and 3 and 4, respectively, making up one half of the first type of subliner element 16, and the other three nano tape segments 39 would be located between panel-shaped segments 34 numbered 5 and 6, 6 and 7, and 7 and 8, respectively, making up the other half of the first type of subliner element 16. No nano tape segment is located between panels 4 and 5.

It will be understood by those skilled in the art that nano tape 39 may be any nano tape which is commercially available. In general, nano tape 39 is an clastic tape that includes a nanofiber or nanotube structure which adheres to an adjacent surface due to molecular Van der Waals forces. In one embodiment, the nano tape 39 is comprised of carbon nanotube arrays provided on a backing layer formed of a flexible polymer, such as polyurethane, with Van der Waals interactions occurring between the carbon nanotube arrays and individual nanotubes and the adjacent surface. The nano tape is in the range of 0.5 to 2.0 mm thick and most preferably 1.0 mm thick.

While the preferred embodiment discloses eight panel-shaped segments 34, the present disclosure is not so limited. Any number of panel-shaped segments 34 could be used depending on the size of the helmet and size of the user. Similarly, while it is preferred the two inner most panel-shaped segments 34 be in direct contact without nano-tape therebetween, additional panel-shaped segments 34 could also be in direct contact without nano-tape therebetween.

With continued reference to FIG. 3, a mounting plate 40 is affixed to one end of the first type of subliner element 16 and extends generally perpendicular to the major side surfaces 36 of the panel-shaped segments 34. The mounting plate 40 is positioned between the first type of subliner element 16 and the shell 24. The minor side surfaces 38 of the panel-shaped segments 34 that face the inner shell 24 are permanently adhered to one side of the mounting plate 40 using a suitable flexible adhesive to form an assembled first type of subliner element 16. This maintains the two nano tape assembled halves 16*a*, 16*b* of the first type of subliner element 16 in proper alignment at the free minor side surfaces 38. The mounting plate 40 is preferably flexible and made of an clastic impact resistant polymer such as ABS having a thickness preferably between 0.25 mm to 1.0 mm.

A hook part 30 and a loop part 32 of a hook and loop fastener mechanism is used to secure the first type of subliner element 16 to the inner surface 22 of the inner shell 24. The hook part 30 and loop part 32 are preferably of a type in common usage today for such applications. More specifically, the surface of the mounting plate 40 opposite the first type of subliner element 16 has one of a hook or loop portion of the hook and loop fastener mechanism secured thereto enabling the assembled first type of subliner element 16 to be removably affixed to the inner surface 22 of the inner shell 24 of the helmet to which the other of hook or loop portion of the hook and loop fastener system is adhered. The perimeter of mounting plate 40 preferably extends beyond the area of the adhered first type of subliner element 16 to maximize the ability of the hook and loop fastener mechanism to firmly hold the assembled first type of subliner element 16 in place during use, including during impacts. The end of the first type of subliner element 16 opposite the mounting plate 40 is referred to as the head end 43.

Figure 3A:
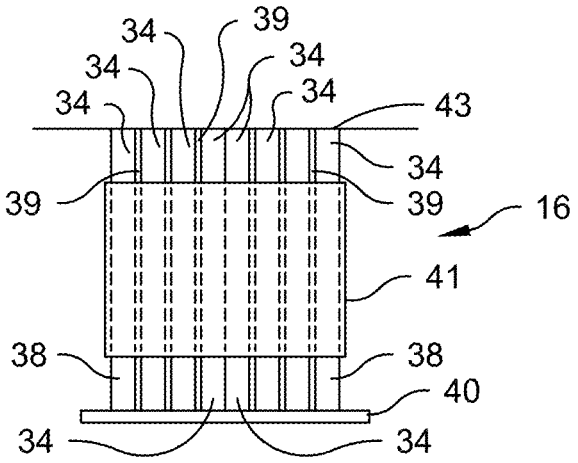
FIG. 3A is a side elevational view of an assembled first type of subliner element.
Figure 3B:
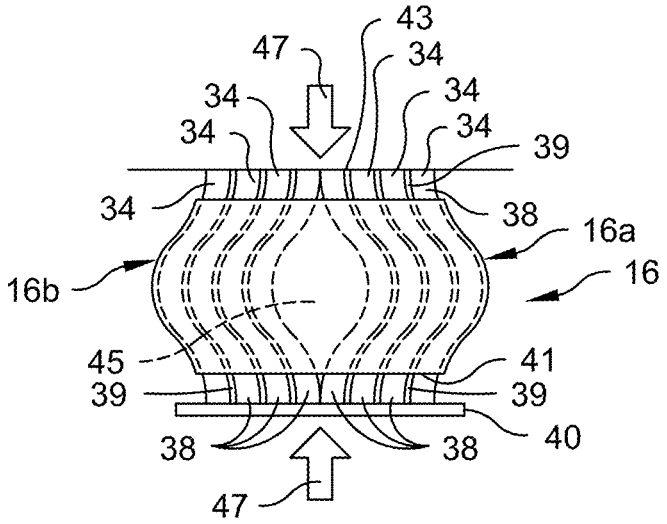
FIG. 3B is a side elevational view of the assembled first type of subliner element being compressed by an impact where the compression is approximately 25%.
Figure 3C:
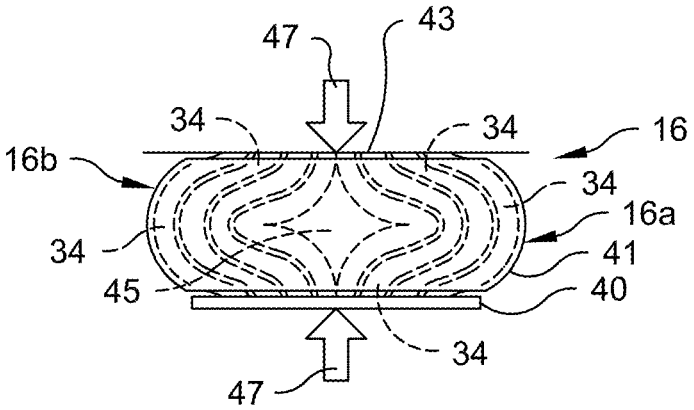
FIG. 3C is a side elevational view of the assembled first type of subliner element being compressed by an impact where the compression is over 50%.

Referring to FIGS. 3A-3C, during an impact involving significant compression of the first type of subliner element 16, the two subliner halves 16*a*, 16*b* are able to bulge away from each other, this bulging being accompanied by localized bending within each of the two subliner element halves 16*a*, 16*b*, primarily near their midpoint between the mounting plate 40 and the head end 43.

The first type of subliner element 16 further includes an elastic element 41 surrounding at least a portion of the first type of subliner element 16 between the mounting plate 40 end and a head end 43 of the first type of subliner element 16 opposite the mounting plate 40. The clastic element 41 preferably has a radial length which is at least 50% of a length of the panel-shaped segments 34 between the mounting plate 40 and the head end 43 of the first type of subliner element 16 opposite the mounting plate 40.

The clastic element 41 is preferably in the form of a thin clastic sheet that surrounds the assembled first type of subliner 16 in a region between the mounting plate 40 and the head end 43 of the first type of subliner element 16 to hold the two first type of subliner halves 16*a*, 16*b* together prior to an impact, and to return the subliner halves 16*a*, 16*b* to their pre-impact condition following an impact. The radial length of the clastic element 41 should preferably cover at least 25% to 75%, and preferably about 25%, of the distance between the mounting plate 40 and the head end 43 of the first type of subliner element 16. The clastic element 41 should preferably have an elongation capability of at least fivefold because in the first type of subliner element's 16 pre-impact condition shown in FIG. 3A, the clastic element 41 should be at least somewhat stretched to firmly hold the two subliner element halves 16*a*, 16*b* together. During an impact, the clastic element 41 may need to stretch up to another threefold at its maximum stretch location approximately midway between the mounting plate 40 and the head end 43. Natural rubber, or latex, has the property of being able to stretch at least sixfold, so latex may be at least one preferred material for the clastic element 41.

FIG. 3A shows the exploded elements of FIG. 3 assembled into a first type of subliner element 16 in an un-impacted state. The mounting plate 40 is shown at the bottom, and the line at the top represents the head end 43 in contact with the wearer's head.

FIG. 3B shows the first type of subliner element 16 shown in FIG. 3A as it is being compressed by a high-speed impact, represented by the arrows 47, in which the level of compression has reached approximately 25%, which can typically occur in just 3 or 4 milliseconds. In this case, the two halves 16*a*, 16*b* of the first type of subliner element 16 have separated at the middle to form a central opening 45 and causing bending of the panel-shaped segments 34 as a result of that separation. The very rapid bending of the viscoelastic panel-shaped segments 34 causes a localized portion of the nano tape 39 surface in fixed contact with a localized convex portion of the major side surface 36 of panel-shaped segment 34 to rapidly elongate compared to the opposite surface of the nano tape 39 segment in fixed contact with a localized portion of the concave major side surface 36 of panel-shaped segment 34 which is rapidly shortening. This results in rapid shearing across the very thin thickness of the localized nano tape 39 and coupled with the high effective viscosity of the nano tape matrix material, this results in localized areas of significant nano tape energy absorption. There is also some energy absorption as a result of the compression of the viscoelastic panel-shaped segments 34, at the top and bottom, and somewhat lesser energy absorption in the viscoclastic panel-shaped segment 34 as a result of the bending.

FIG. 3C shows the first type of subliner element 16 of FIG. 3B after an additional 5 milliseconds have passed when its compression has now reached more than 50%. In this case, the inner panel-shaped segments 34 now display more severe localized bending mid span, and how the outer panel-shaped segments 34 display less severe bending but over a more spread-out, less localized, area. This shows that the energy absorption from the nano tape 39 has continued at a similar level as before as a result of the more but less rapid bending, as indicated by the longer time span. The center opening 45 still exists and the folded-over viscoelastic panel-shaped segments 34 are now differently oriented and present a greater area for resisting additional compression. The over 50% compression point is where normally a straight compressing viscoclastic foam block would enter its densification region where the force would begin to go up exponentially with additional compression. Densification is the last stage of compression for a foam material where all the spaces are gone and only solid material remains to be compressed. But here, the center opening 45, the reoriented panel-shaped segments 34, and the greater compression area all combine to help avoid densification and its damaging higher forces and accelerations, including rotational accelerations. Along with the additional nano tape energy absorption, avoiding densification is another major advantage of the disclosed subliner configuration.

Although FIGS. 3B and 3C show a straight compression situation, the first type of subliner element 16 deforms similarly under a combination of compression and shear, with the shear tending to alter the symmetrical nature of the deformation shown in the figures. However, there is still substantial energy absorption from both compression and bending of the viscoelastic panel-shaped segments 34 and substantial energy absorption in the nano tape 39 segments as a result of the bending of the panel-shaped segments 34. In addition, all three conditions cited above for reducing the chance of densification still apply.

FIG. 4 is a cross-sectional side view located at the midsagittal plane of the wearer's head 12 showing the three types of subliner elements 16, 18, 20 as located in FIG. 2 and the inner shell 24 to which they are attached. The inner shell 24 may be part of a single liner, single shell helmet 14 as illustrated in the figure, or it may be part of a multiple liner, multiple shell helmet, as discussed in more detail below. The relative size of the inner shell 24 shown in FIG. 4 at the lower end of the indicated radial thickness range would be consistent with the former case if the helmet were for example an equestrian helmet or a ski helmet, and the relative size of the inner shell shown in FIG. 4 would also be consistent with the latter case if the helmet were for example a football helmet or a motorcycle helmet. A football helmet or a motorcycle helmet of the single liner, single shell type would typically have a larger subliner system 10 at the higher end of the indicated radial thickness range, which in that case would also be the outer shell. Thus, in a football helmet or motorcycle helmet of the single liner, single shell type embodiment, the radial spacing of the inner shell 24 from the head 12 would typically be greater than that shown in FIG. 4 and the subliner elements of the first, second and apex types 16, 18, 20 would accordingly have a greater radial dimension.

With continued reference to FIG. 4, the inner surface 22 of the inner shell 24 above subliner element of the apex type 20 is shown to have a flat horizontal surface 42 rather than a concave surface. The inner shell 24 may be molded that way to achieve the flat horizontal surface 42. The flat horizontal surface 42 is not absolutely necessary but it is preferred to enable the apex type of subliner element 20 to be flat on its upper surface as well as its lower surface 20*a*, which helps to assure a horizontal lower surface 20*a*, and makes it simpler and more controllable to determine, select, and properly align and apply a proper thickness subliner element of the apex type 20 so that it's lower surface 20*a* remains horizontal and preferably barely touches the wearer's head 12. As shown in FIG. 4, the two cross-sectioned subliner elements of the second type 18 are shown in the third area C, properly radially compressed, as would be all of the other subliner elements of the second type 18 not shown in the cross-section, when all are supporting the full weight of the helmet, even though the full helmet with all its potential parts, including a potential face guard and a potential chin strap or jaw strap system, is not shown in FIG. 4. Finally, the subliner elements of the first type 16 in the first area A each have a thickness to yield a snug but not uncomfortable fit with the wearer's head 12.

Figure 5:
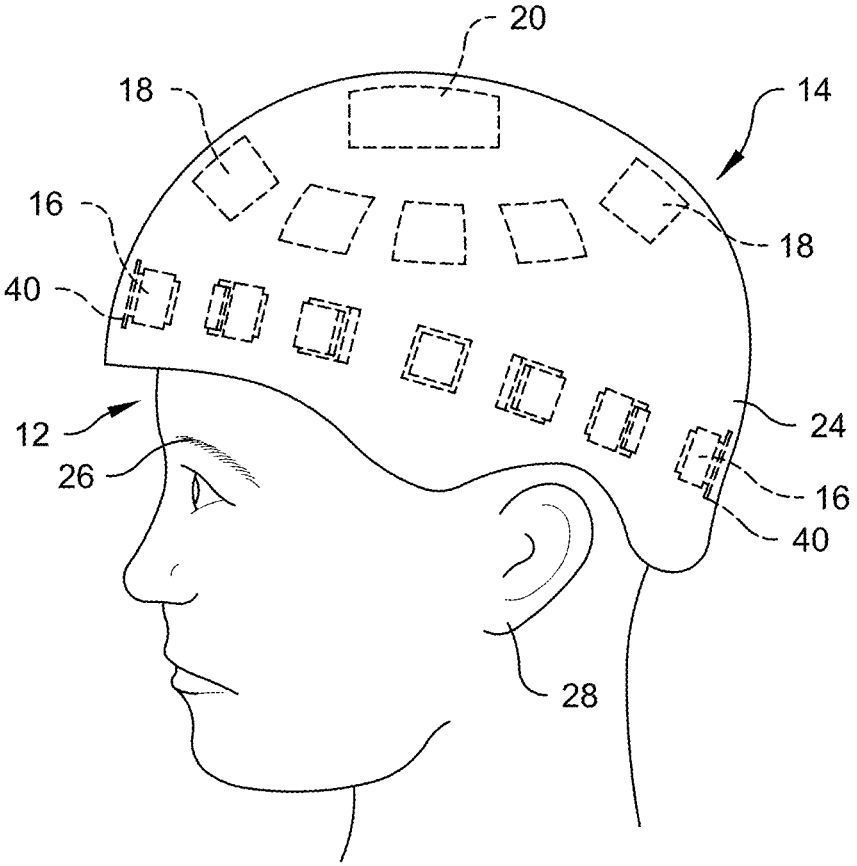
FIG. 5 is a left side elevational view showing the inner shell of FIG. 4 positioned on a wearer's head.

FIG. 5 is a left side elevational view of the wearer's head 12 showing the inner shell 24 of FIG. 4 located over the wearer's head 12 with all the subliner elements of the first, second and apex type 16, 18, 20 positioned as shown in phantom and as in FIG. 2; all of the subliner elements of the first, second and apex type 16, 18, 20 being attached to the inner surface 22 of the inner shell 24, typically by the easy-on, easy-off, hook and loop fastener mechanism 30, 32 shown in FIG. 3. The easy-on, easy-off capability helps in being able to customize the helmet for an individual wearer. The potential materials to be used for the inner shell 24 would depend upon which embodiment it is being used in. In the single liner, single shell helmet embodiment the inner shell 24 (which is now also the outer shell) must be able to handle a direct impact, so an impact resistant material such as polycarbonate or high impact ABS would be appropriate. In the multiple liner, multiple shell helmet embodiment described in more detail below, the inner shell 24 need not handle a direct impact, but it still would need to be able to handle high forces so a high strength polymer composite containing either glass fibers, carbon fibers, or KEVLAR® fibers (commonly understood as heat-resistant and strong synthetic fibers) or a composite utilizing a combination of different fibers could be appropriate. Also, for this embodiment, the inner shell 24 could be constructed of a thin metal, such as stainless steel or an aluminum alloy (either perforated, or not perforated), and in large quantities could be fabricated by pressing it to shape in a die with a large machine press. Such a thin metal shell, perhaps a thirty-second of an inch or less in thickness, could weigh even less than a comparable polymer composite shell.

Figure 6:
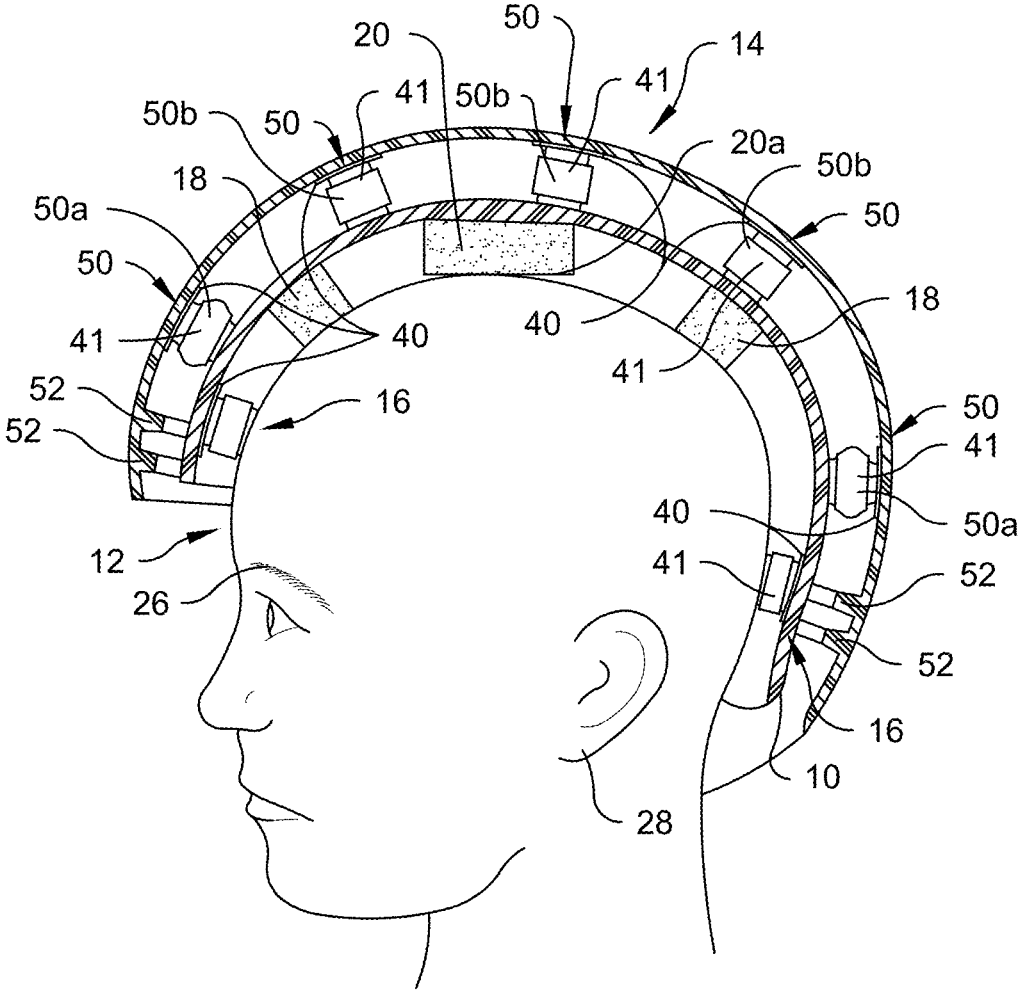
FIG. 6 is a cross-sectional side view at the midsagittal plane of a wearer's head, of a two liner, two shell helmet embodiment, where the subliner elements and the inner shell shown in FIG. 4 and FIG. 5 make up a subliner system, to which is added a second liner and an outer shell, the second liner being attached to both the inner shell and the outer shell in accordance with the present disclosure.

FIG. 6 is a cross-sectional side view located at the midsagittal plane of a wearer's head 12, showing a two liner, two shell, helmet 14 embodiment of the present disclosure. FIG. 6 shows the subliner system 10 of FIG. 4, plus a second or outer liner 44 and a second or outer shell 46 which together form an outer shell system 48. Five outer liner elements 50 are shown in the second liner 44 because they cross the midsagittal plane. Typically, there may be ten to fifteen additional liner elements 50 in the second liner 44 which are not shown in FIG. 6 because they do not cross the midsagittal plane. That would add up to a likely total of fifteen to twenty total outer liner elements 50 in the second liner 44, spread out more or less equidistantly throughout the available space between the inner shell 24 and the second or outer shell 46.

All the outer liner elements 50 of the second liner 44 are firmly attached to both the outer surface of the inner shell 24 and the inner surface of the outer shell 46. By contrast, subliner elements of the first, second and apex types, 16, 18, 20 in the subliner system 10 can only be attached to the inner shell 24 (they cannot be attached to a wearer's head). The firm attachment of the outer liner elements 50 of the second liner 44 to both the inner and outer shells 24, 46 enables the outer liner elements 50 to experience not just high compression forces, but high shear forces and high tensile forces as well. As a result, the attachment requirement here is beyond the capability of a standard hook and loop fastener and is more in the realm of a high strength, wide temperature range, flexible adhesive, such as LOCTITE® 4902, or LOCTITE® Plastic Bonder, both by Henkel Corporation. The former is a one-part adhesive, the latter a two-part adhesive, and both are quick curing.

These flexible, high strength attachments make it possible for all the outer liner elements 50 of the second liner 44 to participate in mitigating any impact to the wearer's head 12, regardless of the impact's location or direction. That mitigation is accomplished through the widespread positioning of the outer liner elements 50 and their ability to efficiently absorb energy in three different modes: compression, shear, and tension. For example, for any centered impact the outer liner elements 50 of the second liner 44 generally located in the region beneath the impact will experience compression, those located to the side of the impact will experience shear, and those located opposite the impact will experience tension, while those located in between will experience some combination of compression, shear, and tension. For any non-centered impact most of the outer liner elements 50 of the second liner 44 will experience a higher degree of shear. Because every impact is different in its location and direction, each outer liner element 50 in the second liner 44 must be able to absorb energy at all the expected possible levels of compression, shear, and tension, and combinations thereof.

Furthermore, in order to even be in a position of optimally absorbing energy, each outer liner element 50 of the second liner 44 must become deformed during an impact to its full extent by the outer shell 46, not just those outer liner elements 50 beneath the impact, but those to the side of the impact, and those opposite the impact as well, and the outer shell 46 must remain rigid enough during the impact to be able to accomplish that. Because the outer shell 46 is relatively thin and typically made of a polycarbonate or high impact ABS, this may require that the outer shell 46 be rigidized, especially near its opening to accommodate a wearer's head 12, which is the place where it is the weakest. Notice in the figure, that there are two molded-in internal rings 52 near the opening to accomplish the rigidizing, but other rigidizing approaches such as severe contouring or metal banding (not shown) would also be acceptable.

Achieving the optimum energy absorption by all the outer liner elements 50 of the second liner 44 also requires they be fabricated of a material having an inherent high energy absorbing capability, and that the material also have a proper level of dynamic stiffness for the total outer liner element 50 footprint area. To meet these criteria, the outer liner elements 50 of the second liner 44 may be fabricated from the same list of materials recommended for subliner elements of the first and apex types 16, 20, the list including: a vinyl nitrile foam such as IMPAX® VN600, VN740, or VN1000 by Dertex Corporation, or a polyurethane foam such as LAST-A-FOAM® FP 8015 by General Plastics Manufacturing Company. However, in block form, each material likely presents too much dynamic stiffness in shear as compared to its dynamic stiffness in compression and tension. So to reduce an outer liner element's dynamic stiffness in shear, without at the same time reducing its dynamic stiffness in compression or tension, partitioning of each outer liner element 50 into discrete adjacent segments is preferred, similar to what has been previously discussed for the first type of subliner elements 16, panel-shaped segments 34 with nano tape 39 segments located therebetween, except there is no nano tape 39 segment between the middle two panel-shaped segments 34. The outer liner elements 50 located around the periphery of the helmet, in their pre-impact, installed condition should be preferably partially compressed, approximately 25% as shown in FIG. 3B, in order to be able to experience a sudden change in bonding during an impact, not only in compression, but also in tension as when the impact occurs opposite their location. That way the nano tape 39 is able to absorb energy when otherwise it would not. This is feasible for the oppositely located, peripheral outer liner elements 50*a* because the pre-impact forces they exert on the two shells cancel out. No such cancellation is possible for the outer liner elements 50*b* which are not located on the periphery. There is no opposite second liner element for these and they would be installed in an un-compressed condition as shown in FIG. 3A. There is no loss of function in doing so, as these inner outer liner elements 50*b* are not likely to experience tension during an impact.

Figure 7:
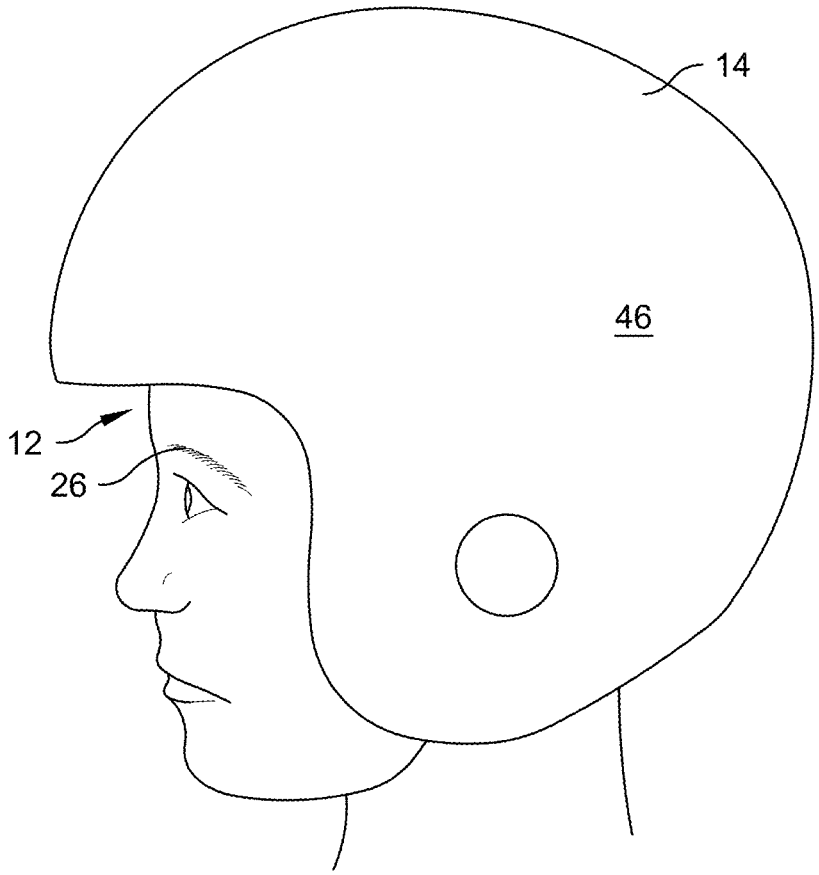
FIG. 7 is a left side elevational view showing the outer shell of FIG. 6 positioned on a wearer's head.

FIG. 7 illustrates a left side elevational view showing the outer shell 46 of FIG. 6 positioned on a wearer's head 12. The size and shape of the outer shell 46 might be typical of a football helmet.

Figure 8:
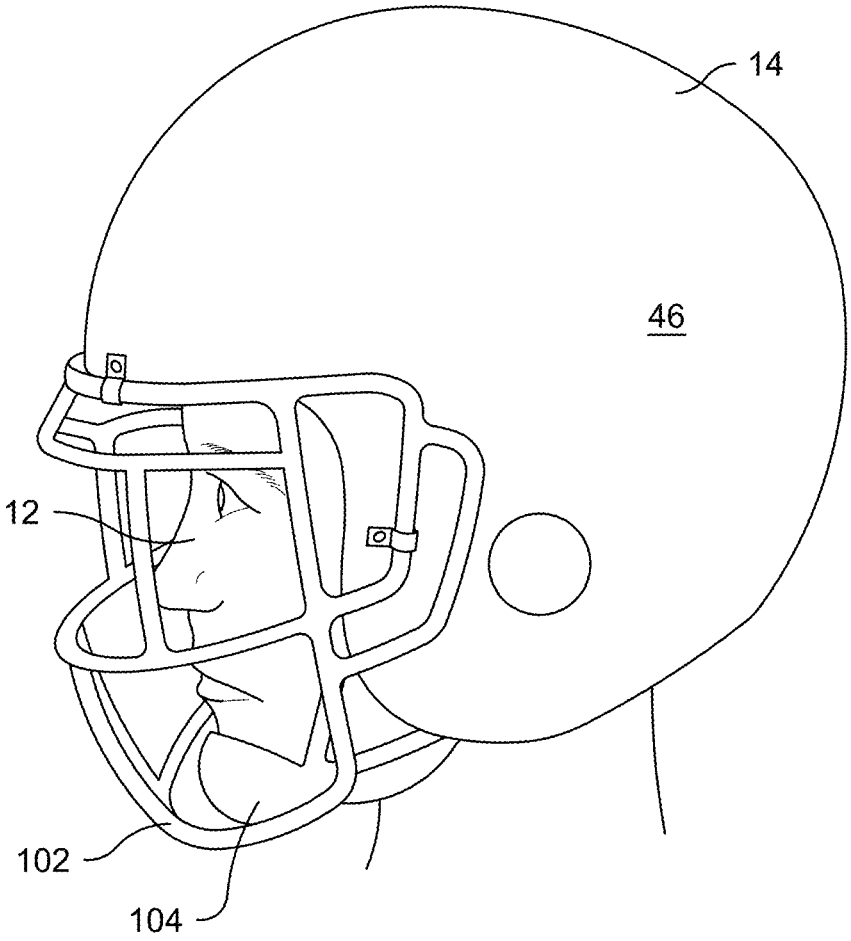
FIG. 8 is a left side elevational view of a wearer's head showing a face guard attached to the outer shell of FIG. 7, and a chin strap positioned on the wearer's chin and attached to the inner shell of FIG. 5.

FIG. 8 is a left side elevational view of a wearer's head 12 showing a face guard 102 attached to the outer shell 46 of FIG. 8, and a chin strap 104 positioned on the wearer's chin and attached to the inner shell 24 of FIG. 5, both typical of a football helmet application.

Finally, although only a first preferred embodiment having a subliner system 10, and a second preferred embodiment having a subliner system 10 and an outer shell system 48 have been described in significant detail, the addition of a third liner and a third shell (not shown) would still be within the scope of the present disclosure. It will also be appreciated by those skilled in the art that changes, or modifications could be made to the above-described embodiments without departing from the broad inventive concepts of the disclosure. Therefore, it should be appreciated that the present disclosure is not limited to the particular use or particular embodiments disclosed but is intended to cover all uses and all embodiments within the scope or spirit of the described disclosure.

I claim:

1. A helmet adapted to be worn on a head of a wearer, the helmet comprising:

a shell comprised of a hard impact resistant material, the shell having inner and outer surfaces, the shell adapted to surround at least a portion of a cranial part of wearer's head with the inner surface of the shell being spaced from the wearer's head at an initial pre-impact relative position when the helmet is worn; and a subliner, at least a part of which is adapted to be in contact with the wearer's head when the helmet is worn prior to an impact and during an impact, the subliner comprising:

at least one subliner element extending from the inner surface of the shell, the at least one subliner element being constructed of an energy absorbing viscoelastic foam material, the at least one subliner element being radially partitioned into individual and independent panel-shaped segments nested with respect to each other and having major side surfaces;

at least some of the nested segments have double-sided nano tape positioned between the major side surfaces thereof in direct contacting engagement with the nano tape and at least some of the major side surfaces of the remaining nested segments are in direct facing relation without nano tape therebetween.

2. The helmet as recited in claim 1, wherein the panel-shaped segments are generally flat.

3. The helmet as recited in claim 1, wherein the double-sided nano tape is positioned between at least a majority of the facing major side surfaces of the panel-shaped segments except for two of the panel-shaped segments generally centrally positioned in the subliner element.

4. The helmet as recited in claim 3, further including a mounting plate affixed to one end of the subliner element and extending generally perpendicular to the major side surfaces of the panel-shaped segments, the mounting plate being positioned between the subliner element and the shell.

5. The helmet recited in claim 4, further including an elastic element surrounding at least a portion of the subliner element between the mounting plate end and an end of the subliner element opposite the mounting plate.

6. The helmet as recited in claim 5, wherein the elastic element has a length which is at least 25% of a length of the panel-shaped segments between the mounting plate and the end of the subliner element opposite the mounting plate.

7. The helmet as recited in claim 1, wherein the nano tape is in a range of 0.5 to 2.5 mm thick.

8. A helmet adapted to be worn on a head of a wearer, the head having a pair of eyebrows and a pair of ears, the head having an annular headband shaped area encircling the wearer's head, the headband shaped area being approximately 0.75 to 1.25 inches wide and having a lower edge defining a plane positioned approximately 0.5 to 1.5 inches above the eyebrows and approximately 0.25 to 0.75 inches above an upper junction of the ears and the wearer's head, a top area centered about a top of the wearer's head encompassing approximately 0.44 to 7 square inches, and a middle area of the head defined between the headband area and the top area, the helmet comprising:

a shell comprised of a hard impact resistant material, the shell having inner and outer surfaces, the shell adapted to surround at least a portion of a cranial part of wearer's head with the inner surface of the shell being spaced from the wearer's head at an initial pre-impact relative position when the helmet is worn; and a subliner, at least a part of which is adapted to be in contact with the wearer's head when the helmet is worn prior to an impact and during an impact, the subliner comprising:

a plurality of a first type of subliner elements extending from the inner surface of the shell at a location such that the first type of subliner elements are adapted to be aligned with the headband area when the helmet is worn, the first type of subliner elements being constructed of an energy absorbing viscoelastic foam material, the first type of subliner elements being radially partitioned into individual and independent panel-shaped segments nested with respect to each other and having major side surfaces, at least some of the nested segments have double-sided nano tape positioned between the major side surfaces thereof in direct contacting engagement with the nano tape and at least some of the major side surfaces of the remaining nested segments are in direct facing relation without nano tape therebetween; and an apex type of subliner element extending from the inner surface of the shell at a location such that the apex type of subliner element is adapted to be aligned with the top area when the helmet is worn, the apex type of subliner element being comprised of an energy absorbing viscoelastic foam material, the apex type of subliner element having a substantially flat lower surface which is substantially tangent to a surface of the wearer's head beneath it when the helmet is worn.

9. The helmet as recited in claim 8 further including at least one of a second type of subliner element extending directly or indirectly from the inner surface of the shell at a location such that the at least one of the second type of subliner element is adapted to be aligned with the middle area when the helmet is worn, the at least one of the second type of subliner element being constructed of a foam material, the at least one of the second type of subliner element being positioned between the plurality of the first type of subliner elements and the apex type of subliner element.

10. The helmet as recited in claim 8, wherein the panel-shaped segments are generally flat.

11. The helmet as recited in claim 8, wherein the double-sided nano tape is positioned between at least a majority of the facing major side surfaces of the panel-shaped segments except for two of the panel-shaped segments generally centrally positioned in the first type of subliner element.

12. The helmet as recited in claim 11, further including a mounting plate affixed to one end of the first type of subliner element and extending generally perpendicular to the major side surfaces of the panel-shaped segments, the mounting plate being positioned between the subliner element and the shell.

13. The helmet recited in claim 12, further including an elastic element surrounding at least a portion of the subliner element between the mounting plate end and an end of the subliner element opposite the mounting plate.

14. The helmet as recited in claim 13, wherein the elastic element has a length which is at least 25% of a length of the panel-shaped segments between the mounting plate and the end of the subliner element opposite the mounting plate.

15. The helmet as recited in claim 8, wherein the energy absorbing viscoelastic foam material of the first type of subliner elements is adapted to exhibit a compressive stress of at least 50 psi for a dynamic compression of 50%, and the energy absorbing viscoelastic foam material of apex type of subliner element is adapted to exhibit a compressive stress of at least 50 psi for a dynamic compression of 50%.

16. The helmet as recited in claim 8, wherein the plurality of first type of subliner elements are generally evenly spaced throughout a circumference of the headband area.

17. The helmet as recited in claim 8, wherein the first and apex type of subliner elements are releasably secured to the inner surface of the inner shell using hook and loop material.

18. The helmet as recited in claim 8, wherein the nano tape is in a range of 0.5 to 2.5 mm thick.

19. A helmet adapted to be worn on a head of a wearer, the head having a pair eyebrows and a pair of ears, the head having an annular headband shaped area encircling the wearer's head, the headband shaped area being approximately 0.75 to 1.25 inches wide and having a lower edge defining a plane positioned approximately 0.5 to 1.5 inches above the eyebrows and approximately 0.25 to 0.75 inches above an upper junction of the ears and the wearer's head, a top area is centered about a top of the wearer's head encompassing approximately 0.44 to 7 square inches, and a middle area of the head defined between the headband area and the top area, the helmet comprising:

an inner shell comprised of a hard material, the inner shell having inner and outer surfaces, the inner shell adapted to surround at least a portion of a cranial part of wearer's head with the inner surface of the inner shell being spaced from the wearer's head at an initial pre-impact relative position when the helmet is worn;

a subliner, at least a part of which is adapted to be in contact with the wearer's head when the helmet is worn prior to an impact and during an impact, the subliner comprising:

a plurality of a first type of subliner elements extending from the inner surface of the shell at a location such that the first type of subliner elements are adapted to be aligned with the headband area when the helmet is worn, the first type of subliner elements being constructed of an energy absorbing viscoelastic foam material, the first type of subliner elements being radially partitioned into individual and independent panel-shaped segments nested with respect to each other and having major side surfaces; at least some of the nested segments have double-sided nano tape positioned between the major side surfaces thereof in direct contacting engagement with the nano tape and at least some of the major side surfaces of the remaining nested segments are in direct facing relation without nano tape therebetween; and an apex type of subliner element extending from the inner surface of the shell at a location such that the apex type of subliner element is adapted to be aligned with the top area when the helmet is worn, the apex type of subliner element being comprised of an energy absorbing viscoelastic foam material, the apex type of subliner element having a substantially flat lower surface which is substantially tangent to the surface of the wearer's head beneath it when the helmet is worn;

an outer shell comprised of a hard impact resistant material, the outer shell having inner and outer surfaces, the outer shell surrounding at least a portion of the inner shell, the inner surface of the outer shell being spaced from the outer surface of the inner shell at an initial pre-impact relative position; and a plurality of outer liner elements located in the space between the outer surface of the inner shell and the inner surface of the outer shell and attached to both the outer surface of the inner shell and the inner surface of the outer shell wherein at least one of the outer liner elements is comprised of an energy absorbing viscoelastic foam, the at least one outer liner element being radially partitioned into individual and independent panel-shaped segments nested with respect to each other and having major side surfaces; at least some of the nested segments of the at least one outer liner element have double-sided nano tape positioned between the major side surfaces thereof in direct contacting engagement with the nano tape and at least some of the major side surfaces of the remaining nested segments of the at least one outer liner element are in direct facing relation without nano tape therebetween.

20. The helmet as recited in claim 19, wherein the panel-shaped segments are generally flat.

21. The helmet as recited in claim 19 wherein in the first type of subliner element and the at least one outer liner element the double-sided nano tape is positioned between at least a majority of the facing major side surfaces of the panel-shaped segments except for two of the panel-shaped segments generally centrally positioned therein.

22. The helmet as recited in claim 19, further including a mounting plate affixed to one end of the first type of subliner element and extending generally perpendicular to the major surface of the panel-shaped segments, the mounting plate being positioned between the first type of subliner element and the inner shell.

23. The helmet as recited in claim 22, further including a mounting plate affixed to one end of the at least one outer liner element and extending generally perpendicular to the major surface of the panel-shaped segments thereof, the mounting plate being positioned between the at least one outer element and the outer shell.

24. The helmet as recited in claim 23, further including an elastic element surrounding at least a portion of the first type of subliner element and the at least one outer liner element between the mounting plate end and an end of the first type of subliner element and at least one outer liner element opposite the mounting plate.

25. The helmet as recited in claim 24, wherein the elastic element has a length which is at least 25% of a length of the panel-shaped segments between the mounting plate and the end of the first type of subliner element and at least one outer element opposite the mounting plate.

26. The helmet as recited in claim 19, wherein the energy absorbing viscoelastic foam material of the first type of subliner elements and at least one outer element is adapted to exhibit a compressive stress of at least 50 psi for a dynamic compression of 50%, and the energy absorbing viscoelastic foam material of apex type of subliner element is adapted to exhibit a compressive stress of at least 50 psi for a dynamic compression of 50%.

27. The helmet as recited in claim 19, wherein the first and apex type of subliner elements are releasably secured to the inner surface of the inner shell using hook and loop material.

28. The helmet as recited in claim 19, wherein the nano tape is in the range of 0.5 to 2.5 mm thick.

* * * * *